United States Patent [19]

Herzog

[11] 3,935,502

[45] Jan. 27, 1976

[54] BALLAST CIRCUIT FOR ELIMINATING FLICKER IN GASEOUS DISCHARGE LAMPS

[75] Inventor: Rollie R. Herzog, Danville, Ill.

[73] Assignee: Construction Materials Division General Electric Company, Indianapolis, Ind.

[22] Filed: Apr. 6, 1973

[21] Appl. No.: 348,671

[52] U.S. Cl. ..... 315/94; 315/98

[51] Int. Cl.[2] ..... H05B 39/00

[58] Field of Search ..... 315/94, 98, 223, 194, 95, 315/228, 195

[56] References Cited

UNITED STATES PATENTS

| | | | |
|---|---|---|---|
| 2,298,589 | 10/1942 | Reitherman et al. | 315/98 |
| 2,988,670 | 6/1961 | Gernuit | 315/98 |
| 3,201,645 | 8/1965 | Strecker | 315/98 |
| 3,265,907 | 8/1966 | Kurata et al. | 315/98 X |

*Primary Examiner*—Nathan Kaufman

[57] ABSTRACT

A ballast especially useful in forming symmetrical half cycles of lamp current during dim light level operation, and thus in overcoming a type of lamp flicker. The light level of the lamp is controlled by an intensity selector circuit which controls an auxiliary circuit that, in turn, controls the ballast circuit. The intensity selector circuit comprises an oscillator which produces timing pulses at a frequency controlled by a potentiometer. The oscillator operates a control switch in the auxiliary circuit and the control switch supplies gate current for a power switch. The power switch controls the ballast circuit which turns on the lamp during a portion of each current half cycle; the light level being determined by the length of the conduction portion of that half cycle. The ballast circuit comprises primary, secondary, and heating windings mounted on a common core. The primary winding is connected to ground through a resistor. The heating windings, first and second secondary windings, and the lamp electrodes are substantially floating with respect to ground. The first and second secondary windings are electrically isolated from one another. These features of the improved ballast circuit overcome flicker at dim levels by enabling the lamp to conduct current symmetrically during each half cycle.

8 Claims, 5 Drawing Figures

BALLAST CIRCUIT FOR ELIMINATING FLICKER IN GASEOUS DISCHARGE LAMPS

BACKGROUND OF THE INVENTION

This invention relates to an improvement in ballast circuits and, more particularly, ballast circuits for controlling gaseous discharge lamps at low intensity or dim light levels.

Ballast circuits are, in general, used to regulate the amount of current through a gaseous discharge lamp having electrodes at each end. They primarily consist of impedance devices such as inductors, capacitors and transformers. Dimming circuits have been designed for use in conjuction with ballast circuits which are used to dim the lamp by allowing it to conduct only during a portion of each half cycle of input voltage. To simplify, the lamp is dimmed by turning on later in its current half cycle to obtain different light levels. It is desirable that the eye not see this turning off and on or a flicker will be observed. In studying auto-transformer type ballasts, having associated dimming circuits, it was noticed that flicker occurred at low light levels. There may be several causes of this instability.

Many prior art ballast circuits have one side, namely one of the heating windings, connected to ground through a resistor. The lamp electrodes are connected to the heating windings, and thus one of the electrodes is grounded. The ballast circuit as well as the case in which it is mounted should be grounded to reduce the hazard of electrical shock. However, when the ballast circuit is grounded through one of its heating windings, the lamp is noticed to flicker during low light intensity levels. When lamp current in the above arrangement is shown with an oscilloscope, a lack of symmetry of alternate half cycles has been observed by applicant. Applicant further has recognized that this lack of symmetry occurs because one electrode of the lamp is connected to ground while the other electrode is not. The main problem is that at low light levels, the lamp must be re-ionized for each half cycle. Since only one of the electrodes is grounded, through a resistor, one electrode will rise to a higher potential above ground than the other. The grounded side is voltage limited by this, whereas the ungrounded side is not. The ungrounded electrode which furnishes a large number of electrons on its negative half cycle while the grounded electrode frunishes a small number of electrons during its negative half cycle, bcause of the ground limitation. Ionization was, therefore, unequal during successive half cycles.

By using circuits incorporating this invention the ballast circuit is grounded and, at the same time, the attendant problems referred to above are overcome. A substantially symmetrical wave shape for each half cycle of current is secured and the flicker at low light levels is eliminated.

SUMMARY OF THE INVENTION

One object of this invention is to provide a ballast circuit capable of operating gaseous discharge lamps at low light intensity levels without flicker.

Another object is to provide a ballast circuit which maintains symmetrical lamp current during each half cycle, especially during dimming.

In accordance with one form of this invention, there is provided a ballast circuit for overcoming flicker in gaseous discharge lamps at dim or low light levels by eliminating the lack of symmetry of the positive and negative half cycles of lamp current. Primary and secondary windings are mounted on a common core. The primary winding is connected to ground through a resistor. First and second secondary coils are magnetically closely coupled but electrically isolated from one another. A third secondary winding, connected to the first secondary winding, and a capacitor comprise a peaking circuit and provide starting pulses for the lamp. Heating windings, which are also mounted on the core, aid in electron emission and gas excitation at the cathodes of the lamp. The heating windings and the first and second secondary windings are substantially free from ground potential.

BRIEF DESCRIPTION OF THE DRAWINGS

The subject matter which is regarded as the invention is set forth in the appended claims. The invention itself, however, together with further objects and advantages thereof, may be better understood by reference to the following description taken in conjunction with the accompanying drawings in which:

DESCRIPTION OF THE PREFERRED EMBODIMENT

Figure 1:
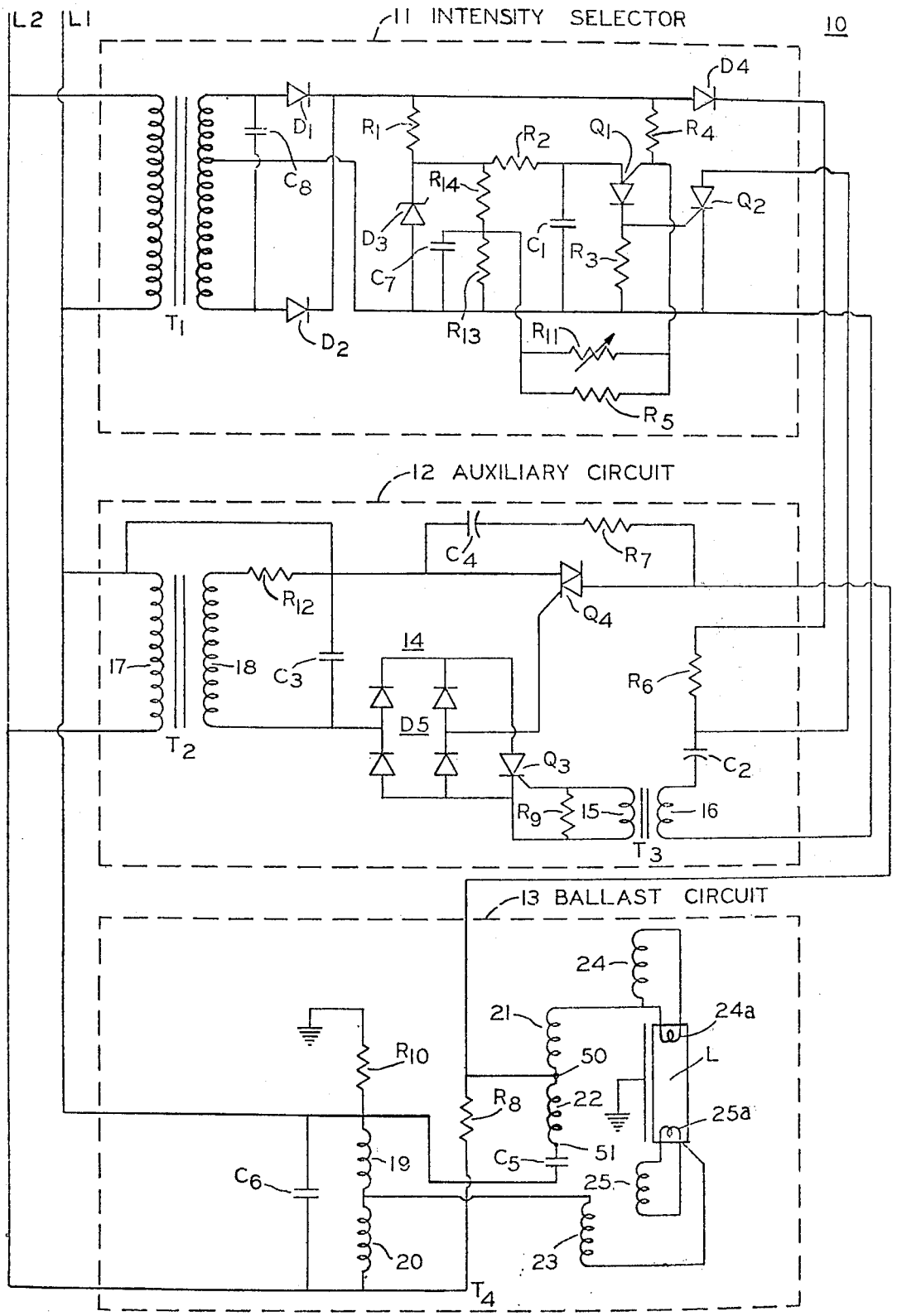
FIG. 1 is a schematic circuit diagram of an improved ballast circuit incorporating one form of the present invention, in combination with a suitable auxiliary circuit and intensity selector circuit.

Referring more particularly to FIG. 1 there is shown a dimming circuit 10 comprising intensity selector circuit 11 which controls auxiliary circuit 12. The auxiliary circuit controls ballast circuit 13 and the ballast circuit controls the operation of gaseous discharge lamp L.

The intensity selector circuit includes programmable unijunction transistor (PUT) $Q_1$ having anode, cathode, and gate electrodes. Capacitor $C_1$ is connected across PUT $Q_1$ and resistor $R_3$, and provides current through the anode and cathode of the PUT. The series circuit comprising resistors $R_1$ and $R_2$ is connected to diodes $D_1$ and $D_2$, and to capacitor $C_1$ to provide charging current for capacitor $C_1$. Diodes $D_1$ and $D_2$ are further connected to transformer $T_1$ to receive input power. Zener diode $D_3$ is connected between resistor $R_1$ and resistor $R_2$ and provides voltage regulation for the intensity selector circuit. Resistor $R_4$ is connected to the gate of PUT $Q_1$ to provide stabilization. SCR $Q_2$ has its gate electrode connected to the cathode of PUT $Q_1$. Resistor $R_5$ and variable resistor $R_{11}$, which serves as the master potentiometer, are connected to the gate of PUT $Q_1$, and controls the amount of time the lamp is off by determining when capacitor $C_1$ discharges. The light level in the lamp is directly proportional to the period of conduction of the lamp. Various intensity selector circuits of this type have been more completely described in application, Ser. No. 246,974, filed Apr. 24, 1972 for Rollie R. Herzog and Frank A. Neusbaum and assigned to the General Electric Company, assignee of the present invention.

The auxiliary circuit 12 includes a control switch 14 and power switch $Q_4$. The control switch 14 comprises SCR $Q_3$ connected across diode bridge $D_5$. Resistor $R_6$, Capacitor $C_2$ and the primary winding 16 of a transformer $T_3$ are connected in a series arrangement and provide gating current to the control switch 14. Resistor $R_6$ provides a charging path for capacitor $C_2$ from diode $D_4$ and diodes $D_1$ and $D_2$. Capacitor $C_2$ and primary winding 16 are connected across SCR $Q_2$. Capacitor $C_2$ discharges through primary winding 16 when SCR $Q_2$ comes on. Secondary winding 15 is magnetically coupled to primary winding 16 and is further connected to the gate of SCR $Q_3$ to provide gating current for the control switch. The control switch is connected to the gate electrode of power switch $Q_4$ which is used to control the ballast circuit 13. The illustrated auxiliary circuit is more completely described in application Ser. No. 348,676 filed Apr. 6, 1973, for Rollie R. Herzog and assigned to the General Electric Company, assignee of the present invention.

The improved ballast circuit 13 includes transformer $T_4$ which has primary windings 19 and 20 and may operate with 277 volts across both windings or 120 volts across primary winding 19 only. To simplify, the 277 volt operation and connection will be described. Secondary windings 21–23 are mounted on the opposite side of a core (not shown) from the primary windings. Secondary winding 21 is split from winding 23, that is, they are electrically isolated from one another but magnetically coupled to one another. This isolation helps to provide a balanced system for equal lamp electrode voltages for alternate half cycles. Secondary winding 22 is connected across nodes 50 and 51. Capacitor $C_5$ is connected to Triac $Q_4$ and secondary winding 22 at node 51 to store energy which will be used to start the lamp. Capacitor $C_5$ and secondary winding 22 form a peaking circuit which provides a high voltage spike for lamp starting. Resistor $R_8$ is connected to A.C. line 1 and to secondary winding 22 at node 50 to provide a charging path for capacitor $C_5$.

Secondary windings 21 and 23 are magnetically coupled to secondary winding 22 which induces starting voltage into windings 21 and 23 when capacitor $C_5$ discharges. Secondary windings 21 and 23 are connected to electrode heating windings 24 and 25 which are closely coupled to primary windings 19 and 20 respectively. The heating windings are connected to electrodes 24*a* and 25*a* to provide heating current for the electrodes. The electrodes are balanced with respect to ground, that is, they are essentially at the same absolute voltage, one above and the other below ground. Some prior art ballasts grounded one of the lamp electrodes causing a flicker to occur at low light levels a fact which was recognized by applicant. With the ground connection removed from the formerly grounded lamp electrode, each electrode receives approximately an equal excitation voltage for its negative half cycle during starting. Therefore, an approximate equal number of electrons are released from the respective electrodes and gas excitation or ionization around each electrode will be nearly equal.

In the past, when one electrode was grounded, the lamp was essentially required to operate on the excitation of the ungrounded electrode only. At dim light levels flicker was noticed because of low excitation voltage for the grounded electrode on its negative half cycle.

The ground for the ballast circuit is provided through resistor $R_{10}$ at primary winding 19 permitting the cathodes to remain ungrounded. Capacitor $C_6$ is connected across the primary windings 19 and 20 and to resistor $R_{10}$ and provides power factor correction.

The overall operation of the circuit is as follows: 60Hz power is provided for the intensity selector circuit, the auxiliary circuit and the ballast circuit through main supply leads $L_1$, $L_2$. Capacitor $C_1$ charges through resistors $R_1$ and $R_2$ and is discharged through programmable unijunction transistor $Q_1$ at a time in the power half cycle approximately proportional to the reistance of $R_5 \times R_{11}/R_5 + R_{11}$. The amount of time the lamp is off and thus, lamp intensity, may be varied by varying resistor $R_{11}$, known as the master potentiometer. Each discharge of capacitor $C_1$ turns on SCR $Q_2$. This energizes the auxiliary circuit.

Concurrently, capacitor $C_2$ is charged through diode $D_4$ and resistor $R_6$. It is then discharged through SCR $Q_2$ and primary winding 16 when $Q_2$ comes on. This forms a pulse across secondary winding 15 which turns on control switch 14. The Control switch provides a constant gating current for triac $Q_4$ from the time the oscillator provides a pulse until zero cross-over of current occur in the control switch.

Capacitor $C_5$ is charged through resistor $R_8$ and secondary winding 22 and is discharged through winding 22 and through triac $Q_4$ when the triac is gated on. Discharge of capacitor $C_5$ through winding 22 induces a voltage spike in secondary windings 21 and 23 of sufficient magnitude to provide a starting pulse for the lamp. A series current path is provided from one side of the A.C. source $L_2$, through primary winding 20, secondary winding 23, through lamp L, secondary winding 21, and triac $Q_4$ to the other side $L_1$ of the A.C. source.

In the past where the secondary coils were not split and one of the cathodes was grounded there was an inherent lack of symmetry of the lamp current. This lack of symmetry was the cause of flicker at low light levels. The improved ballast circuit balances the secondary windings and the cathodes. Since neither of the cathodes of the lamp is at ground potential and the two secondary windings 21 and 23 have been split, the A.C. current through the lamp is uniform for each half cycle and flicker is eliminated.

Figure 2:
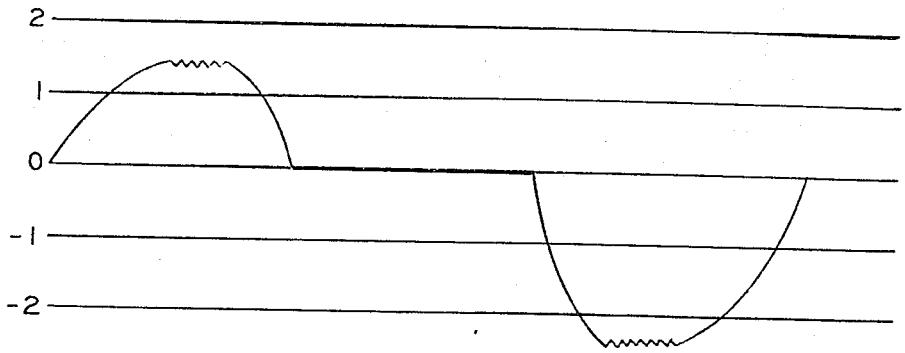
FIG. 2 PRIOR ART
FIG. 2 is a graph of the waveforms of lamp current using a prior art ballast circuit.
Figure 3:
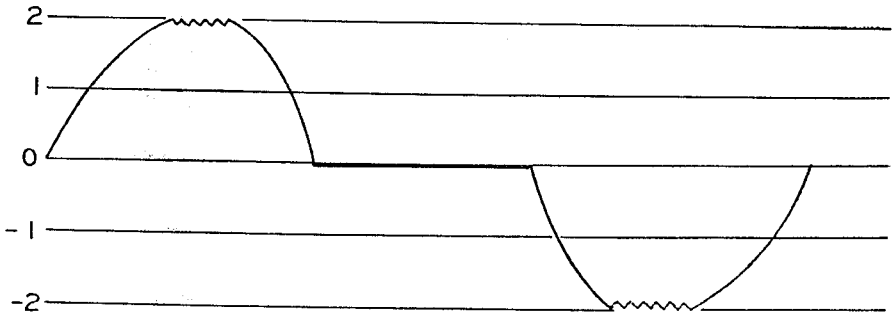
FIG. 3 is a graph of the waveforms of lamp current using the exemplification ballast circuit of FIG. 1 of this application.

The operation of the circuit in comparison with the prior art can be more fully appreciated by referring to the waveforms in FIGS. 2 and 3.

FIG. 2 illustrates a waveform of the current through a fluorescent lamp controlled by a prior art ballast circuit where one end of the lamp is grounded and a single starting secondary is used. As can be seen, the positive and negative half cycles lack symmetry and have different amplitudes.

FIG. 3 illustrates the waveform of current through a fluorescent lamp controlled by the improved ballast circuit. The waveforms are symmetrical, that is, equal and opposite, for each half cycle.

Figure 4:
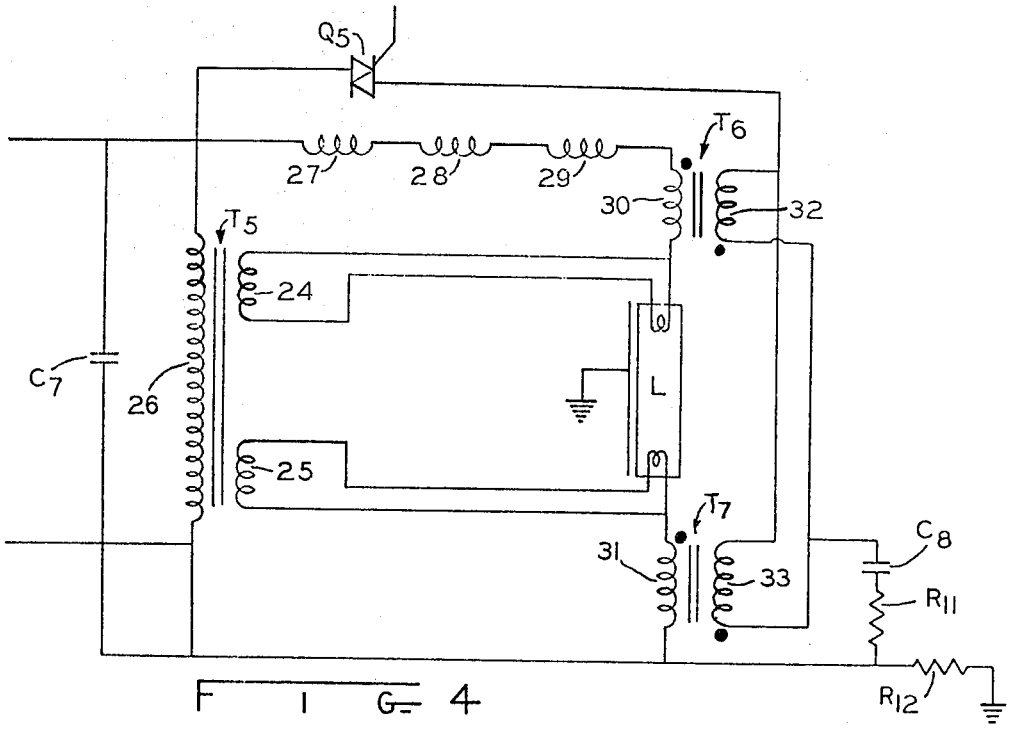
FIG. 4 is a schematic circuit diagram of another embodiment of the improved ballast circuit.

FIG. 4 shows another embodiment of the invention for use with 277 volt input across the primary. Capacitor $C_7$ is connected across the 277 volt input and provides power factor correction. Primary winding 26 of transformer $T_5$ is also connected across the input and provides power for heating coils 24 and 25. The heating windings are isolated from ground in order to provide symmetry for lamp current. The heating windings 24 and 25 are connected to secondary windings 30 and 31 respectively. Inductors 27 and 28 and 29 are connected in series with secondary winding 30, lamp L, and secondary winding 31 and provide ballasting for lamp L. Primary windings 32 and 33 are closely coupled to secondary windings 30 and 31 and provide pulses to start lamp L. Triac $Q_5$ is connected to the primary windings and is used to switch current for starting pulses. Capacitor $C_8$ is connected to ground through resistors $R_{11}$ and $R_{12}$ and to primary windings 32 and 33 to complete a peaking or starting circuit.

Figure 5:
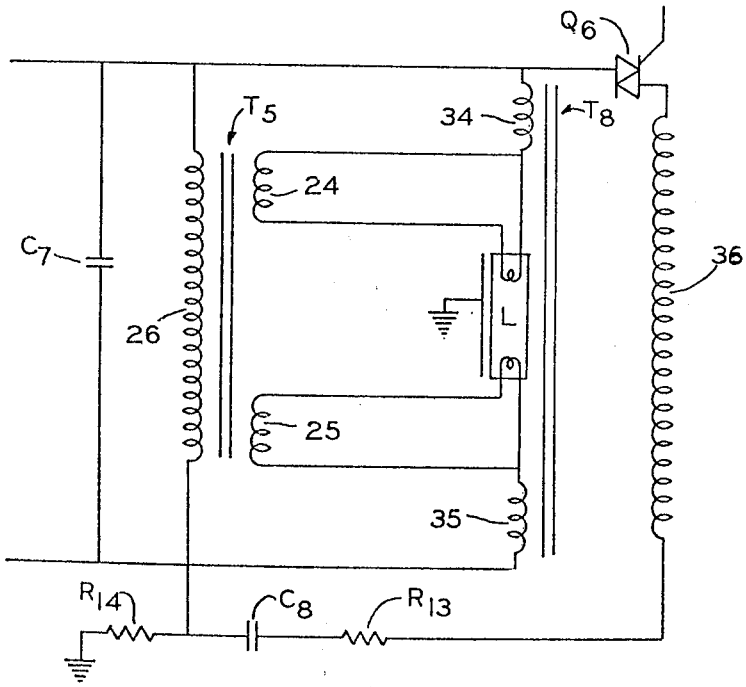
FIG. 5 is a schematic circuit diagram of still another embodiment of the improved ballast circuit.

FIG. 5 shows still another embodiment of the invention for use with a 277 bolt input where the circuit is simplified. The differences in FIG. 5 are that only one primary winding 36 is used to start the lamp and that secondary windings 34 and 35 are also used to ballast the lamp as well as start it.

The circuit of FIG. 1 has been built and operated with components having the following set of values:

| | | | |
|---|---|---|---|
| Resistor | $R_1$ | — | 1 K |
| | $R_2$ | — | 100 K |
| | $R_3$ | — | 1 K |
| | $R_4$ | — | 15 K |
| | $R_5$ | — | 10 K |
| | $R_6$ | — | 100 K |
| | $R_7$ | — | 100 ohms |
| | $R_8$ | — | 220 K |
| | $R_9$ | — | 1 |
| primary | | | |
| | $R_{10}$ | — | 2 Meg. |
| | $R_{11}$ | — | 10 K pot |
| | $R_{12}$ | — | 100 ohms |
| | $R_{13}$ | | |
| primary | 680 | | |
| | | ms | |
| | $R_{14}$ | — | 4.7 K |
| Diode | $D_1$ | — | 400 V, 1 A |
| | $D_2$ | — | 400 V, 1 A |
| | $D_3$ | — | 10 V, Zener 100 and MA |
| | $D_4$ | — | 400 V, 1 A |
| | $D_5$ | — | Full Wave Bridge with 4 Diodes - 400 V DC, 1 A DC, 280 V RMS |
| PUT | $Q_1$ | — | 2N6027 |
| SCR | $Q_2$ | — | 2N4184 |
| | $Q_3$ | — | C106B2 — G.E. No. |
| TRIAC | $Q_4$ | — | 500 V, 15 amp 85°C |

Transformer $T_1$
primary winding — 1690 turns, .0063 in. dia.
secondary winding — 2 windings (420 turns, .0063 in. dia.)

Transformer $T_2$
primary winding 17 — 1690 turns, .0063 in. dia.
secondary winding 18 — 132 turns, .010 in. dia. dia.

Transformer $T_3$ primary winding 15 — 1000 turns, .0045 in. dia.
secondary winding 16 — 1000 turns .0045 in. dia.

Transformer $T_4$ primary winding 19 — 1048 turns, .0071 in. dia.
primary winding 20 — 1241 turns, .010 in. dia.
secondary winding 21 — 598 turns, .0119 in. dia.
secondary winding 23 — 373 turns, .0119 in dia.
heating winding 24 — 42 turns, .010 in. dia.
heating winding 25 — 42 turns, .010 in. dia.

| | | |
|---|---|---|
| Capacitor | $C_1$ | — .047 μf |
| | $C_2$ | — .01 μf |
| | $C_3$ | —.047 μf |
| | $C_4$ | — .05 μf |
| | $C_5$ | — .01 μf |
| | $C_6$ | — 1.9 μf |
| | $C_7$ | — .01 μf |
| | $C_8$ | — .15 μf |

From the foregoing description of the illustrative embodiments of the invention, it will be apparent that many modifications may be made therein. It will be understood that these embodiments of the invention are intended as exemplification of the invention only and that the invention is not limited thereto. It is to be understood, therefore, that it is intended in the appended claims to cover all modifications as fall within the true spirit and scope of the invention.

What I claim as new and desire to secure by Letters Patent of the United States is:

1. A ballast circuit for controlling the current through at least one gaseous discharge lamp having first and second electrodes comprising:

a primary winding;

first and second secondary windings electrically coupled to said primary winding, one end of each of said first and second secondary windings adapted to be coupled respectively to the first and second electrodes;

first and second heating windings for providing heating power to the first and second lamp electrodes respectively, said first and second heating windings respectively connected to one end of said first and one end of said second secondary windings, said one end of each of said first and second secondary windings being free from a substantially direct connection to ground so that the first and second electrodes may vary substantially from ground potential.

2. The ballast circuit as set forth in claim 1 further including:

means for pulse starting the lamp connected to at least one of said first and second secondary windings.

3. The ballast circuit as set forth in claim 2 wherein said means for pulse starting the lamp includes:

a third secondary winding coupled to the other side of said first secondary winding and further includes a capacitor connected to said third secondary winding.

4. The ballast circuit as set forth in claim 2 further including:

control means for appling a dimming signal connected to said means for pulse starting the lamp whereby the ionization level at each lamp electrode is substantially equal to each other to provide lamp operation which is substantially free from flicker.

5. The ballast circuit as set forth in claim 4 wherein one side of said primary winding is connected to ground.

6. A ballast circuit for controlling the current through at least one gaseous discharge lamp having first and second electrodes comprising:

a transformer having at least a primary and first and secondary windings;

means for connecting one side of said primary winding to ground;

one side of said first secondary winding and one side of said second secondary winding being adapted to be connected respectively to the first and second electrodes of the lamp, the other side of said first secondary winding and the other side of said second secondary winding each being connected to said primary winding; said one side of said first secondary winding and said one side of said second secondary winding being free from a substantially direct connection to ground so that said one side of each of said first and second secondary windings may vary substantially from ground potential;

dimming means connected to the other side of said first secondary winding for controlling the light level in the lamp whereby the lamp operation is substantially free from flicker.

7. The ballast circuit as set forth in claim 6 wherein: said dimming means includes a power switch having one side connected to said first secondary winding and having the other side adapted to be connected to a potential source.

8. The ballast circuit as set forth in claim 6 wherein said first and second secondary windings are electrically isolated from one another.

* * * * *

UNITED STATES PATENT OFFICE
CERTIFICATE OF CORRECTION

Patent No. 3,935,502 Dated January 27, 1976

Inventor(s) Rollie R. Herzog

It is certified that error appears in the above-identified patent and that said Letters Patent are hereby corrected as shown below:

In the Specification:

Column 5, line 25, the value of "$R_9$" should read -- 1 K--;

Column 5, line 26, "primary" should be deleted;

Column 5, line 28, the value of "$R_{13}$" should be --680 ohms--;

Column 5, line 29, "primary" and "680" should be deleted;

Column 5, line 31, "ms" should be deleted.

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*